US006779761B2

(12) United States Patent
Holgate

(10) Patent No.: US 6,779,761 B2
(45) Date of Patent: Aug. 24, 2004

(54) BROKEN RAIL DETECTION

(75) Inventor: Douglas James Holgate, Chellaston (GB)

(73) Assignee: AEA Technology plc, Didcot (GB)

( * ) Notice: Subject to any disclaimer, the term of this patent is extended or adjusted under 35 U.S.C. 154(b) by 0 days.

(21) Appl. No.: 10/221,148

(22) PCT Filed: Apr. 3, 2001

(86) PCT No.: PCT/GB01/01538

§ 371 (c)(1),
(2), (4) Date: Sep. 10, 2002

(87) PCT Pub. No.: WO01/76927

PCT Pub. Date: Oct. 18, 2001

(65) Prior Publication Data

US 2003/0038216 A1 Feb. 27, 2003

(30) Foreign Application Priority Data

Apr. 7, 2000 (GB) ..... 0008480

(51) Int. Cl.[7] ..... B61K 9/00; B61L 25/00

(52) U.S. Cl. ..... 246/34 R; 246/122 R; 324/217

(58) Field of Search ..... 246/120, 121, 246/122 R, 34 R, 130, 41, 34 C, 34 CT, 34 B; 324/217, 713, 218

(56) References Cited

U.S. PATENT DOCUMENTS 4,117,529 A * 9/1978 Stark et al. ..... 361/182
5,330,135 A * 7/1994 Roberts ..... 246/34 R
5,330,136 A * 7/1994 Colbaugh ..... 246/122 R
5,417,388 A * 5/1995 Stillwell ..... 246/122 R
5,680,054 A * 10/1997 Gauthier ..... 324/713
6,102,340 A * 8/2000 Peek et al. ..... 246/121
6,262,573 B1 * 7/2001 Wojnarowski et al. ..... 324/217
2002/0113170 A1 * 8/2002 Grappone ..... 246/120

OTHER PUBLICATIONS

Steven Shooman, "Broken Rail Detection Without Track Circuits MTA—New York City Transit—a Proposal," presented at the University of Illinois at Urbana–Champaign, Association of American Railroads, Federal Railway Administration, Workshop on Rail Defect Detection and Removal Policies and Broken Rail Detection Technologies, Pueblo, Colorado, Jul. 22–23, 1997.

* cited by examiner

*Primary Examiner*—Mark T. Le
(74) *Attorney, Agent, or Firm*—William H. Holt

(57) ABSTRACT

A break in a rail, where two rails (12, 13) extend parallel to each other along a railway line, is detected by connecting the two rails together electrically with two electrical connections (16, 18) at opposite ends of a section of the line, causing electrical currents to flow in parallel along the two rails from a current source (22), and detecting (24) the currents flowing in each of the rails (12, 13). From the two values of current one can find it there is a break in one of the rails (12, 13). The currents may be measured in one of the connections (16). The current source (22) may be DC or low frequency AC, or a coded pulse sequence.

18 Claims, 2 Drawing Sheets

BROKEN RAIL DETECTION

This invention relates to a method and an apparatus for detecting broken rails.

On many railway lines the presence of a train on a section of track is detected by means of a track circuit, which applies a low voltage between the rails, and detects the change in the resistance between the rails due to the presence of the train as the wheels and axles provide electrical connection between the rails. Track circuits incidentally also enable any break in a rail to be detected. There are however many railway lines in which track circuits are not used, and, especially on such railway lines, a method of detecting any break in a rail would be desirable and conducive to safer operations.

According to the present invention there is provided a method for detecting a break in a rail in a situation where two rails extend parallel to each other along a railway line, the method comprising connecting the two rails together electrically with a first electrical connection at a first location, and also connecting the two rails together electrically with a second electrical connection at a second location spaced apart from the first location along the line, the first electrical connection being connected to a source of electrical current, and the second electrical connection being connected to the current source via a return current path that does not form a part of the same track as either of the rails, so as to cause electrical currents to flow in parallel along the two rails between the first location and the second location, and either (a) detecting any difference between the currents flowing in each of the rails, and hence determining if there is a break in one of the rails, or (b) detecting the currents flowing in each of the rails, and from the two values of current determining if there is a break in one of the rails.

A break in either of the rails in the section of the line between the first location and the second location can hence be detected. Preferably the currents flowing in each of the two rails are detected, and the two values of current are used in determining if a break is present. The currents may be measured in the rails themselves, or more preferably may be measured in electrical connections leading to the rails, for example in the first or the second electrical connection. The currents may be direct, alternating, or pulsed. Preferably the currents have a frequency spectrum in which most or all of the energy is at low frequencies, preferably no more than 20 Hz (because the impedance of the rails increases with frequency). Such low frequency currents may be measured using a non-contact current sensor such as that described in WO 00/63057, but alternative current sensors may also be used.

There is thus an electrical circuit comprising the current source and the two parallel rails, with one side of the current source connected to the first electrical connection and the circuit being completed by the return current path. The return current path may be provided either by an electrical conductor connected between the other side of the current source and the second electrical connection, or by connecting both the current source and the second electrical connection to earth. The method is applicable to tracks that have no track circuits; and (unlike a track circuit) the sensor currents in the rails flow in parallel, so that if there is no rail break there is no voltage between the rails. In the preferred arrangement the two rails form a track for a railway vehicle, but in a multitrack line the two rails may instead be in different tracks.

Preferably the interpretation of the two values of current involves a comparison of at least one of the values with a first threshold value, to indicate if the current is sufficiently large for reliable operation; and also a comparison between the two measured values, to see if the difference between the measured currents exceeds a second threshold value indicating that there is a break in one of the rails. This second threshold value may be a preset proportion of one of the measured values of current, or of the sum of those measured values, and so be related to the current supplied by the current source. As indicated above, the currents may be measured within electrical connections leading to the rails; they may also be measured in such electrical connections at both ends of the section of line.

The invention also provides a system for detecting a break in a rail operating as described above.

Successive sections of the rails, along the line, may be electrically insulated from each other, and each section provided with a separate detection system; each detection system can then operate independently of the others. If that is not the case, so that successive sections of the rails are in electrical contact with each other, then each section may be provided with a separate detection system, and the separate detection systems activated in turn (so that nearby detection systems are not activated at the same time); this again allows each detection system to operate independently. Alternatively each detection system may operate with an alternating current, or a pulsed current, so the currents from nearby detection systems can be distinguished from each other for example by their frequencies. In a preferred embodiment each detection system operates with a pseudo-random pulsed current, the pseudo-random currents having a different pattern in adjacent detection systems; in this case cross-correlation between the observed currents and the expected pseudo-random pulse sequence enables the currents from adjacent detection systems to be distinguished.

The invention will now be further and more particularly described, by way of example only, and with reference to the accompanying drawings in which.

Figure 1:
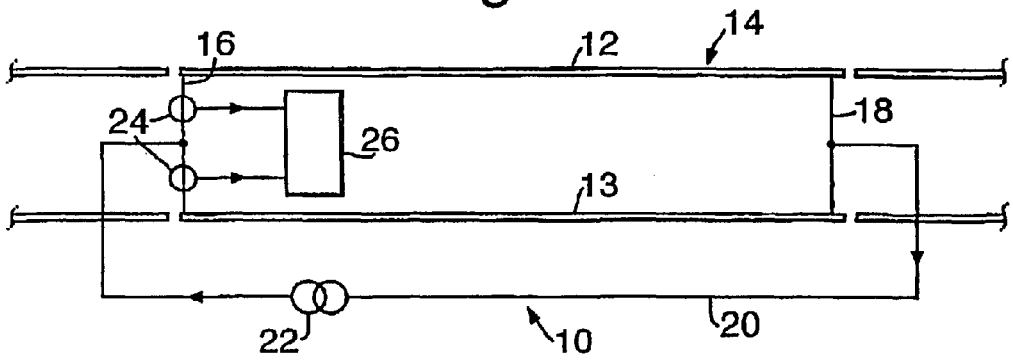
FIG. 1 shows a diagrammatic plan view of a rail break detecting system.

Referring to FIG. 1 a detecting system 10 is shown for detecting breaks in two parallel rails 12, 13 which form part of a railway line but which are electrically isolated from adjacent sections of the line. By way of example the section 14 of line in which the system 10 operates may be of length 5 km. At one end of the section 14 the rails 12 and 13 are connected by a copper conductor 16 and at the other end of the section 14 the rails 12 and 13 are connected by a copper conductor 18. The mid points of the conductors 16 and 18 are each connected by a cable 20 to a source 22 of electric current. Current sensors 24 are arranged to measure the currents flowing in the two halves of the conductor 16, and signals from the sensors 24 are supplied to a processor or computer 26. Each sensor 24 may be a non-contact current sensor such as that described in WO 00/63057.

Each conductor 16 and 18 preferably has a much lower electrical impedance than that of the section 14 of a rail 12 or 13, at the operating frequency of the source 22 (which may be DC). It is consequently desirable that the conductors 16 and 18 be as short as practicable, with the current sensors 24 installed between the rails 12 and 13 as shown. However if the conductors 16 and 18 are of sufficiently large gauge they may be longer, and it may be more convenient to install the sensors 24 in equipment cases (not shown) alongside the track.

It will be appreciated that the typical resistance of a railway rail is about 0.035 Ω/km (for continuous welded rail), so that a low voltage is sufficient to generate a current of say 1 A. If there is no break in either rail 12 or 13 then the currents in each rail will be the same, say 0.5 A, and these values of current are measured by the sensors 24. If there is a failure in the cable 20 or the source 22, then both currents will become zero. The computer 26 monitors the sum of the two values of current, and if the sum falls below a threshold value the computer 26 indicates that such a failure has occurred. If there is a break in one of the rails, say in rail 12, then the current in rail 13 will be greater than that in rail 12; the computer 26 monitors the difference between the two values of current, and if the difference exceeds a threshold value the computer 26 indicates that there is a break in the rail 12 or 13 accordingly.

In a practical railway line the rails 12 and 13 are not well insulated from the environment, so that electric currents can flow from each rail to earth, or to the other rail if there is a potential difference between the rails. If there is no break in either rail 12 or 13 then the potential difference between the rails is negligible, but if there is such a break, in say rail 12, then current leakage between the rails (and to earth) means that the current in rail 12 will not be zero, the actual value of current depending on the position of the break along the rail 12 and upon the electrical resistance between the rails and that between each rail and earth. The difference between the two measured currents (as a proportion of the sum of the currents in the two rails), U, is 1.0 if the break occurs next to the sensors 24, and decreases if the break is further from the sensors 24 to a minimum value (Um) if the break is about three quarters of the way along the section 14, the value of U slightly increasing if the break is even further along the section 14.

Figure 2:
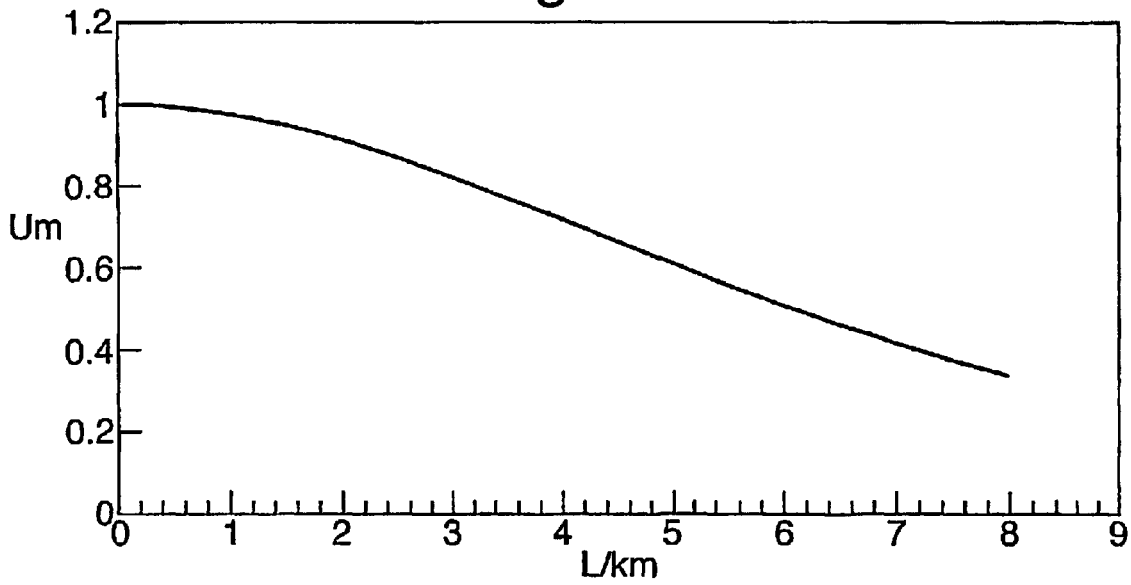
FIG. 2 shows a graphical representation of how the ability to detect rail breaks varies with the length of the section of line.

Referring now to FIG. 2 this shows graphically how the minimum value, Um, varies for different lengths L of the section 14, for typical values of the electrical resistances and leakages. It will be appreciated that the length L should be selected to ensure that Um is not too small, and preferably at least 0.5, to ensure that breaks can be reliably detected.

In a modification of the system 10, the cable 20 is connected sequentially by means of a switching arrangement (not shown) in the conductor 18, to both rails (as shown), to rail 12 only, and to rail 13 only. When the connection is made to both rails, the current measurements are made and the presence of a broken rail is detected as previously described. When the connection is made to rail 12 alone, or to rail 13 alone, there exists an imbalance in the circuit that is similar to that which exists when there is a break in the other (non connected) rail close to connection 18. The current measurements taken in these two deliberately unbalanced states may be used to confirm that the broken rail condition is detectable. Thus, the computer/processor 26 may continually check the ability of the broken rail detection system 10 to function correctly; in particular, the computer/processor 26 is able to identify circumstances where the rail to rail leakage or the rail to earth leakage has increased beyond the normal values such that broken rail detection can no longer be assured.

In the system 10 there are no intentional connections to earth, although there is the incidental connection of the rails 12 and 13 to earth as a result of leakage, as mentioned. The circuit of the system 10 may intentionally be provided with a connection to earth, provided it does not prevent correct operation of the broken rail detection system 10. Such an earth connection may be provided either at the mid point of the conductor 16 (adjacent to the current sensors 24) or at the mid point of the conductor 18 (remote from the current sensors 24). In general the former is preferable as it maximises the differences in the currents if there is a break in a rail.

Figure 3:
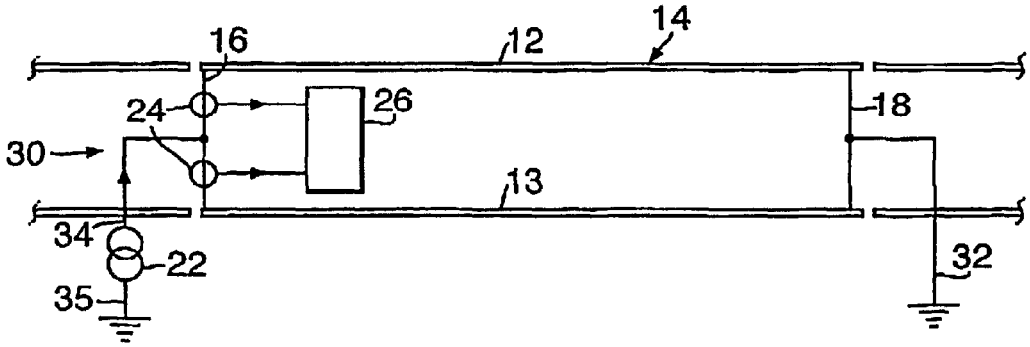
FIG. 3 shows a modification of the detecting system of FIG. 1.

Referring now to FIG. 3 a modified detecting system 30 is shown, most of the features being identical to the system 10 of FIG. 1 and being referred to by the same reference numerals. The system 30 differs only in that the mid point of the conductor 18 is connected by a copper cable 32 to earth, and that the current source 22 is connected by copper cables 34 and 35 between the mid point of the conductor 16 and earth. This system 30 has the advantage that the long length of cable 20 is not required. The system 30 has the disadvantage that not all of the current from the source 22 will pass through the cable 32 from the rails 12 and 13 via the conductor 18, the remainder passing to earth via leakage paths from the rails 12 and 13; this reduces the sensitivity of the system 30 to breaks that are near the conductor 18. It will be appreciated that the system 30 is not optimum in that the intentional earth connection 32 is at the end remote from the current sensors 24.

Figure 4:
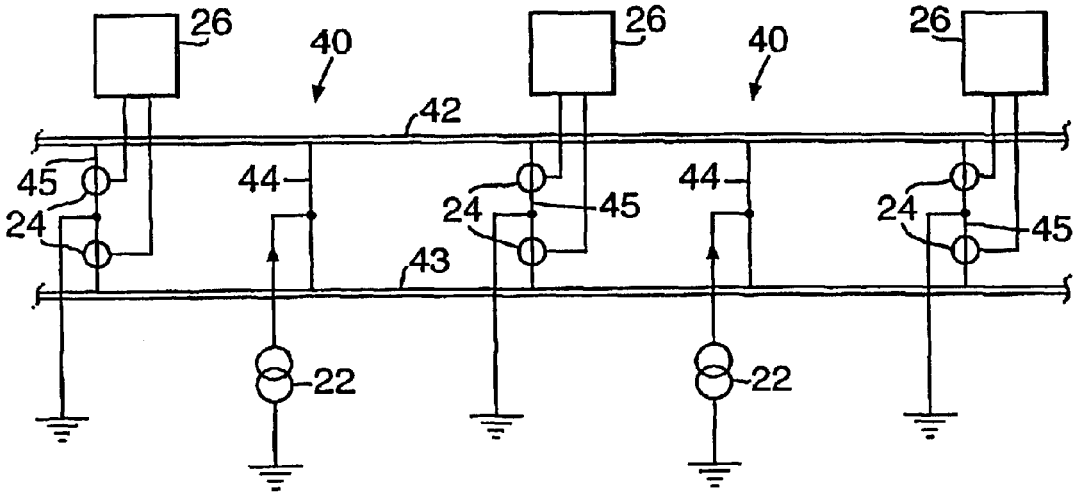
FIG. 4 shows a diagrammatic plan view of an alternative rail break detecting system.

Referring now to FIG. 4, two detecting systems 40 are shown, each having some features in common with the systems 10 and 30 (those features being referred to by the same reference numerals). The system 40 is intended for use on rails 42 and 43 which are electrically continuous for many kilometres. The rails 42 and 43 are divided longitudinally into sections by low impedance electrical connections 44 and 45 between the rails, arranged alternately and at separations between a connection 44 and a connection 45 of 4 km. A current source 22 is connected to the mid point of each electrical connection 44 and to earth; the mid point of each electrical connection 45 is connected to earth immediately adjacent to the connection 45, and current sensors 24 are arranged to measure the currents flowing in the two halves of the connection 45. (As discussed earlier, this is the preferred way of providing an earth connection.) Signals representing the currents detected by the sensors 24 are supplied to computers 26 associated with each connection 45.

Considering a detecting system 40 in isolation, its operation is substantially the same as that of the system 30 of FIG. 3, differing only in that the current source 22 is arranged to send currents along the rails 42 and 43 both to the left and to the right of the connection 44; and that the connection 45 in which the current sensors 24 monitor the currents is the one remote from the current source 22.

It is evident that operation of the systems 40 must be such that the currents detected by current sensors 24 due to one of the current sources 22 must be distinguishable from the currents due to the next current source 22 along the line. In one embodiment this is achieved by activating the current sources 22 in turn: for example in an 80 km length of line there are ten such systems 40, so the current sources 22 might be operated in turn, providing current, for a six second interval once every minute under timer control. In this case each current source 22 may generate DC, alternating, or pulsed current, though the frequency is preferably no more than 20 Hz, and DC operation is preferred.

Alternatively all the current sources 22 may be activated continuously, and the currents from the different current sources distinguished in other ways. In particular each current source 22 may generate a pseudo-random binary sequence at a bit frequency of say 1 Hz, the current sources 22 being arranged so that their pseudo-random binary sequences are all different. Each computer 26 would then have to be programmed to be able to generate two replica pseudo-random binary sequences corresponding to those generated by the nearest source 22 in each direction along the line. The signals detected by each current sensor 24 would then be cross-correlated, (for a range of values of delay), with delayed versions of these two replica pseudo-random binary sequences, the magnitudes of the resulting correlation peaks corresponding to the strengths of the current flowing in the rail 42 or 43 from the corresponding current source 22. For example considering the section of the line between a connection 44 and the next connection 45 to the right (as shown), the computer 26 will cross-correlate the signals from the sensors 24 with a replica of the pseudo-random binary sequence generated by the source 22 to its left (as shown); in each case there should be a peak, and the amplitudes of the peaks correspond to the currents flowing along the rails 42 and 43 from the source 22 to the right. As described earlier in relation to the system 10, the computer 26 monitors the sum of the peak amplitudes (or alternatively, say, the larger of the peak amplitudes), and if this falls below a threshold value the computer 26 indicates that a failure in the current source 22 has occurred. If there is a break in one of the rails, say in rail 42, then the current in rail 43 will be greater than that in rail 42; the computer 26 monitors the difference between the two cross-correlation peak amplitudes, and if the difference exceeds a threshold value the computer 26 indicates that there is a break in the rail 42 or 43 accordingly.

Figure 5:
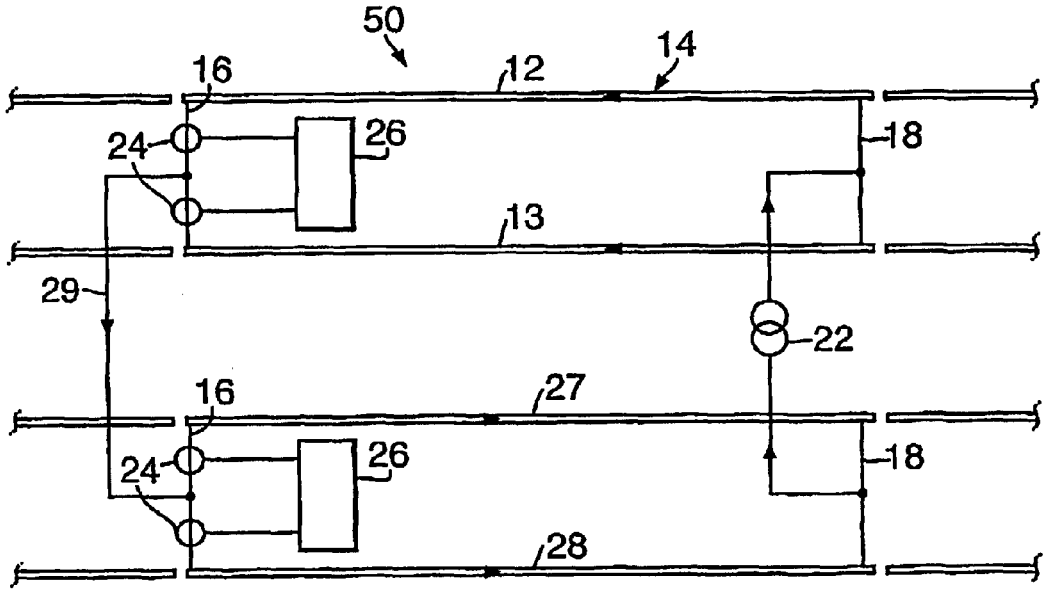
FIG. 5 shows a diagrammatic plan view of another alternative rail break detecting system.

It will be appreciated that the rail break detection systems 10, 30 and 40 are given by way of example only, and that rail break detection systems of the invention may differ from those described while remaining within the scope of the present invention. For example instead of providing a cable 20 to complete the circuit between the ends of a section 14 (as in the system 10), on a line with two or more tracks the circuit may instead be completed by another pair of parallel rails 27 and 28 as shown in FIG. 5 to which reference is now made. The system 50 of FIG. 5 has many features which are identical to those in the system 10 of FIG. 1, these being referred to by the same reference numerals. In the system 50 the current source 22 is connected between the midpoints of conductors 18 that link the pairs of rails 12, 13 and 27, 28 respectively. At the other end of the section 14 a cable 29 connects the midpoints of conductors 16 that link the pairs of rails 12, 13 and 27, 28 respectively. As in the system 10, in each case current sensors 24 detect the currents in the two parts of the conductor 16, and computers 26 compare the values of current as described earlier. The system 50 enables breaks in any one of the rails 12, 13, 27 and 28 to be detected; however the length of the section 14 over which it can operate will generally be less than that over which the system 10 can operate.

It will be appreciated that on a line with two or more tracks, the system 40 can also be modified so as to use an adjacent pair of rails to complete the electrical circuit instead of relying on earth connections; the modifications are substantially the same as those described in relation to the system 50.

What is claimed is:

1. A method for detecting a break in a rail in a situation where two rails extend parallel to each other along a railway line, the method comprising connecting the two rails together electrically with a first electrical connection at a first location, and also connecting the two rails together electrically with a second electrical connection at a second location spaced apart from the first location along the line, the first electrical connection being connected to a current source of electrical current, and the second electrical connection being connected to the said current source via a return current path that does not form part of the same track as either of the rails for causing electrical currents to flow in parallel along the two rails between the first location and the second location, and either (a) detecting any difference between the currents flowing in each of the rails for determining if there is a break in one of the rails, or (b) detecting the currents flowing in each of the rails for determining if there is a break in one of the rails, wherein said current source is fixed relative to said rails, and injects into said first electrical connection a current of a predetermined and identifiable waveform.

2. A method as claimed in claim 1 wherein the currents are measured in the first electrical connection or the second electrical connection between the rails.

3. A method as claimed in claim 1 in which one side of the current source is connected to the first electrical connection, and both the other side of the current source and the second electrical connection are connected to earth to provide the return current path.

4. A method as claimed in claim 3 wherein the currents in the rails are detected in the vicinity of an earth connection.

5. A method as claimed in claim 1 further includes an interpretation of two values of the currents flowing through the rails, the interpretation includes a comparison of at least one of the values with a first threshold value, to indicate if the current is sufficiently large for reliable operation; and also a comparison between the two measured values, to see if the difference between the measured currents exceeds a second threshold value indicating that there is a break in one of the rails.

6. A method as claimed in claim 1 wherein the current source generates a pseudo-random binary sequence.

7. A method as claimed in claim 1 wherein a multiplicity of said first electrical connections are provided at locations spaced apart along said railway line, a multiplicity of said second electrical connections are provided at intermediate locations spaced apart along said line, and a multiplicity of said current sources are provided for supplying currents of predetermined and identifiable waveforms to the respective second electrical connections.

8. A method as claimed in claim 7 wherein said current of a predetermined and identifiable waveform has an alternating or pulsed waveform of frequency no more than 20 Hertz.

9. A method as claimed claim 7 wherein each said rail is electrically continuous along a section of said line in which there are a multiplicity of said current sources, and each of said current sources injects currents continuously for generating a pseudo-random binary pulse sequence different from that generated by adjacent ones of said current sources.

10. A system for detecting a break in a rail in a situation where two rails extend parallel to each other along a railway line, the system comprising a first electrical connection connecting the two rails together at a first location, a second electrical connection connecting the two rails together at a second location spaced apart from the first location along the line, a current source of electrical current connected to the first electrical connection, and the second electrical connection being connected to said current source via a return current path that does not form part of the same track as either of the rails, so that first and second electrical currents flow in parallel along the two rails between the first location and the second location, current detection means for detecting either (a) any difference between the first and second currents, or (b) detecting the value of the first and second currents flowing in each of the rails, and determination means responsive either to the difference between the currents, or responsive to the values of the first and second currents, for determining if there is a break in one of the rails, wherein said current source is fixed relative to said rails, and arranged to inject into said first electrical connection a current of a predetermined and identifiable waveform.

11. A system as claimed in claim 10 wherein one side of the current source and the second electrical connection are both connected to earth to provide the return current path.

12. A system as claimed in claim 11 wherein the current detection means are arranged in the vicinity of an earth connection.

13. A system as claimed in claim 10 wherein the return current path is provided by a second pair of rails that extend along the railway line and by first and second electrical connections connecting the two rails of the second pair together at locations spaced apart along the line, so that electrical currents flow in parallel along the two rails of the second pair.

14. A system as claimed in claim 10 wherein the current detection means measures currents in an electrical connection connecting the two rails together.

15. A system as claimed in claim 10 including a multiplicity of said first electrical connections being provided at locations spaced apart along said railway line, a multiplicity of said second electrical connections being provided at intermediate locations spaced apart along said line, and a multiplicity of said current sources being provided for supplying currents of predetermined and identifiable waveforms to the respective second electrical connections.

16. A system as claimed in claim 15 wherein said current of a predetermined and identifiable waveform has an alternating or pulsed waveform of frequency no more than 20 Hertz.

17. A system as claimed in claim 16 wherein each said rail is electrically continuous along a section of said line in which there are a multiplicity of said current sources, and each of said current sources injects currents continuously for generating a pseudo-random binary pulse sequence different from that generated by adjacent ones of said current sources.

18. A method for detecting a break in a rail in a situation where two rails extend parallel to each other along a railway line, the method comprising connecting the two rails together electrically with a first electrical connection at a first location, and also connecting the two rails together electrically with a second electrical connection at a second location spaced apart from the first location along the line, the first electrical connection being connected to a current source of electrical current, and the second electrical connection being connected to said current source via a return current path that does not form part of the same track as either of the rails for causing electrical currents to flow in parallel along the two rails between the first location and the second location, and either (a) detecting any difference between the currents flowing in each of the rails for determining if there is a break in one of the rails, or (b) detecting the currents flowing in each of the rails for determining if there is a break in one of the rails wherein, at the location remote from that at which the currents are detected, the electrical connection is sequentially connected to both rails, to just one rail, and to just the other rail for confirming that a broken rail condition is detectable.

* * * * *